US006601509B2

(12) United States Patent
Noiret et al.

(10) Patent No.: US 6,601,509 B2
(45) Date of Patent: Aug. 5, 2003

(54) SPRING ELEMENT FOR FIXING IN PLACE PRINTING FORMS ON PRINTING FORM CYLINDERS

(75) Inventors: Christophe Noiret, Saint Leu d Esserent (FR); Francois Recolet, Breuil-le-Vert (FR)

(73) Assignee: Heidelberger Druckmaschinen AG, Heidelberg (DE)

( * ) Notice: Subject to any disclaimer, the term of this patent is extended or adjusted under 35 U.S.C. 154(b) by 0 days.

(21) Appl. No.: 10/004,749

(22) Filed: Dec. 4, 2001

(65) Prior Publication Data

US 2002/0073862 A1 Jun. 20, 2002

(30) Foreign Application Priority Data

Dec. 7, 2000 (DE) ..... 100 60 826

(51) Int. Cl.[7] ..... B41F 27/12; B41F 27/06
(52) U.S. Cl. ..... 101/415.1; 101/378
(58) Field of Search ..... 101/415.1, 378

(56) References Cited

U.S. PATENT DOCUMENTS 3,408,933 A * 11/1968 Hermach et al. ..... 101/415.1
3,727,551 A 4/1973 Kostas et al. ..... 101/415.1
4,347,788 A * 9/1982 Dufour et al. ..... 101/415.1
5,284,093 A * 2/1994 Guaraldi et al. ..... 101/415.1
5,749,297 A * 5/1998 Recolet et al. ..... 101/415.1

FOREIGN PATENT DOCUMENTS

| | | |
|---|---|---|
| DD | 261764 A1 | 11/1988 |
| DD | 261770 A1 | 11/1988 |
| DE | 2235119 | 4/1973 |
| EP | 534579 B2 | 4/1999 |
| JP | 02103148 | 4/1990 |

* cited by examiner

*Primary Examiner*—Leslie J. Evanisko
(74) *Attorney, Agent, or Firm*—Davidson, Davidson & Kappel, LLC

(57) ABSTRACT

A device for fastening printing forms (10) on printing form cylinders (1) of rotary printing presses. The printing forms (10) extend into a clamping channel (3) with their leading edge (12) and their trailing edge (13) and are tensioned therein, via clamping elements, on the lateral surface (2) of the printing form cylinder (1) in a circumferential direction of the printing form cylinder (1) and retained in the clamping channel (3). The clamping elements are accommodated on a tensioning shaft (6) which is rotatably inserted in a bore of the printing form cylinder (1). The clamping elements are designed as spring elements (16, 27) in Y-shape (21), including a first and a second resilient section (17, 19).

9 Claims, 5 Drawing Sheets

SPRING ELEMENT FOR FIXING IN PLACE PRINTING FORMS ON PRINTING FORM CYLINDERS

Priority to German Patent Application No. 100 60 826.4, which is hereby incorporated by reference herein, is hereby claimed.

BACKGROUND OF THE INVENTION

The present invention relates to a spring element for fixing in place printing forms on printing form cylinders which are contained in printing units of rotary printing presses, the printing forms being printing forms which have a plate-shaped configuration and feature angularly bent leading edges and trailing edges.

European Patent No. 0 534 579 B2 relates to a device for changing printing plates in a rotary printing press. In this design approach, provision is made for a plurality of leaf springs which are each formed of a leaf spring member and have a U-shaped cross-section. These leaf springs are accommodated in a spring groove. The leaf springs each include a leg via which the leading end of the printing plate is retained in the clamping channel; the leaf springs, moreover, include a second leg via which an angularly bent trailing printing plate edge is fixed in place in the clamping channel of the printing form cylinder. A tensioning spindle is acted upon by a preloading element so that the tensioning spindle can be moved is such a manner that the leaf springs can act both upon a leading edge and upon a trailing edge of a printing plate.

The leaf spring arrangement known from European Patent EP 0 534 579 B2 involves the disadvantageous circumstance that, due to the narrow installation space, the leaf springs cannot be fitted into a preassembled tensioning shaft which is already integrated into the printing form cylinder.

SUMMARY OF THE INVENTION

In view of the indicated related art, an object of the present invention is to provide a spring element which is easy to mount and dismount, for fixing in place printing forms on cylinders.

According to the present invention, this objective may be achieved by a device or fixing printing forms on printing form cylinders of rotary printing presses, the printing forms extending into a clamping channel with their leading edges and trailing edges and, via clamping elements in the clamping channel, being tensioned on the lateral surface of the printing form cylinder in a circumferential direction of the printing form cylinder and retained in the clamping channel. The clamping elements are accommodated on a tensioning shaft which is rotatably accommodated in a bore of the printing form cylinder, and the clamping elements are designed as Y-shaped spring elements including a first and a second resilient section.

The advantages which can be attained using this design approach are to be seen above all in that a tension spring element configured in this manner needs an extremely small installation space and that it can be installed after the tensioning spindle has already been introduced into the receiving bore in the printing form cylinder accommodating the printing form. This involves that the installation work is made easier and rationalized; moreover, the spring element configured according to the present invention for fixing in place printing forms can be replaced in the clamping channel of a printing form cylinder easily. During the replacement of the clamping elements configured according to the present invention, it is not required to remove the cylinder from the side walls of the printing unit, which would result in unjustifiably long standstill times (downtime) of the respective printing unit. A further advantageous aspect of the design approach according to the present invention is to be seen in that a spring element having the design proposed according to the present invention allows both the printing form to be tensioned in a circumferential direction on the lateral surface of the respective printing form cylinder and the leading printing form edge to be fixed in place on a side wall of the clamping channel concurrently with the tensioning of the trailing printing form edge. The configuration of a spring element according to the present invention makes it possible for the printing form ends to be fixed in place in the clamping channel, involving a high retention force, while at the same time permitting compensating movements of the printing form on the lateral surface due to the flexural elasticity of the clamping element configured according to the present invention.

In an advantageous refinement of the idea of the present invention, a plurality of spring elements can be accommodated side by side in the clamping channel of the respective printing form cylinder. This permits an easy mounting or dismounting of the spring elements on printing units of rotary printing presses which contain extremely slender and therefore relatively wide printing form cylinders.

A first variant of an embodiment of the spring elements configured according to the present invention includes a first and a second resilient section made of flexurally elastic material of different material thickness. In this context, in a particularly simple manner in terms of production engineering, the first and the second resilient section can be made of materials of different material thickness which are joined to form a spring element configured according to the present invention, the spring qualities of the spring element being adjustable through the selection of the material thickness. Thus, for instance, the first resilient section which tensions the trailing edge of a printing form in a circumferential direction on the lateral surface of a printing cylinder can be designed with a higher, a greater material thickness in comparison with the second resilient section of the spring element projecting from the first resilient section in a Y-shaped manner.

To improve the transfer of the retention force, the first resilient section designed with a greater material thickness is provided with an angularly bent, hook-shaped end region via which the trailing edge of the printing form to be fixed in place on the lateral surface of the printing form cylinder is grasped and tensioned in a circumferential direction. Because of the flexural elasticity inherent in the first resilient section, the tensional force is permanently transferred to the printing form when the spring element is in a tensioning position.

At a spreading location, the second resilient section of the spring element branches off from the first resilient section in a Y-shaped fashion in a manner which reduces the required installation space. Because of this, the spring element configured according to the present invention can be inserted into the clamping channel provided on the printing form cylinder with the locating section ahead which can easily be introduced into the receiving slot of the tensioning shaft which accommodates and actuates the spring element.

The second resilient section projecting from the first resilient section in a Y-shaped manner includes a curved region at whose side facing the leading edge of the printing form, a linear contact region is formed. Via the linear contact region, the second section abuts against the leading edge of the printing form retained on a side wall of the printing form cylinder and fixes the leading edge permanently in place in the clamping channel while, at the same time, the first resilient section grips under the trailing edge of the printing form with its hook-shaped end, tensioning the printing form in a circumferential direction on the lateral surface of the printing form cylinder.

In addition to configuring the second resilient section of the spring element in a manner that a linear contact with the leading printing form edge is provided, this section can also be provided with coatings which increase the coefficient of friction, pin-shaped retaining elements extending through the angularly bent leading printing form edge, thus fixing in place the leading edge on a side wall of the clamping channel in the printing form cylinder.

In a further variant of an embodiment of the spring element configured according to the present invention, the spring element can be designed in one piece with a continuous locating section from which first and second resilient sections project in a Y-shaped manner. In this variant of an embodiment of the spring element proposed according to the present invention, the first and second resilient sections can be alternately formed on a workpiece in a segment-like manner. The first and second resilient sections are separated from each other by slot-shaped openings so that the one-piece spring element is easy to manufacture in terms of production engineering, using simple forming processes. In this context, according to the second variant of the design approach of the present invention, the end of the first resilient section of the spring element designed in one piece which end grasps the trailing edge of the printing form can be provided with a rounded region which reduces the risk of injury to the person who manually changes the printing form. Besides, the spring elements configured according to the present invention can, of course, also be used for retaining, tensioning and fixing in place plate-shaped printing forms which can be conveyed to the printing form cylinders of rotary printing presses or removed therefrom via automatic or semi-automatic printing plate changing devices.

The design approach proposed according to the present invention, can preferably be used on rotary printing presses, it being particularly preferred for use in web-fed rotary printing presses, for example short-run or newspaper presses.

BRIEF DESCRIPTION OF THE DRAWING

In the following, the present invention will be explained in detail with reference to the drawings in which.

DETAILED DESCRIPTION

Figure 1:
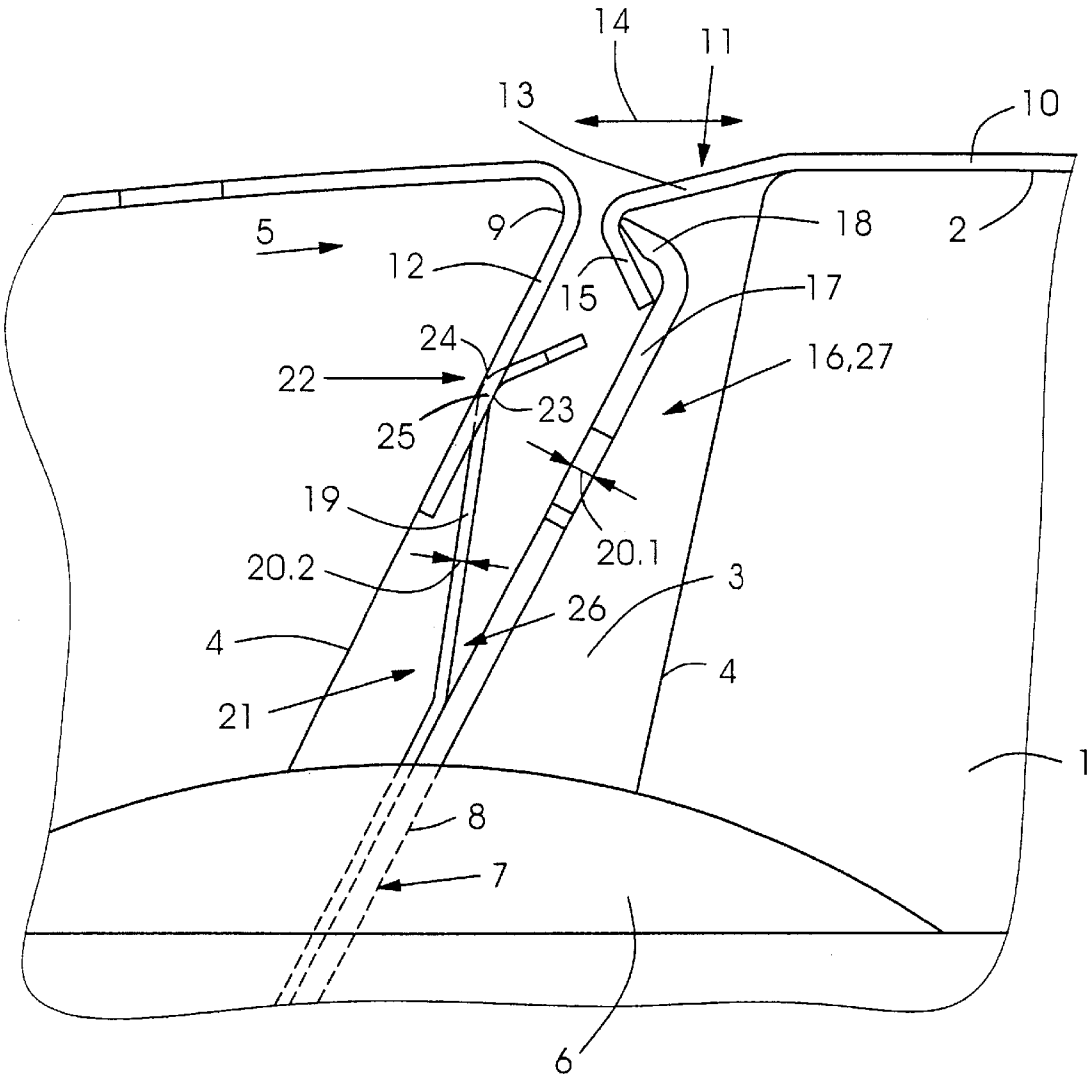
FIG. 1 provides an enlarged-scale view of a clamping channel for receiving the leading and trailing edges of the printing form.

The representation according to FIG. 1 illustrates in greater detail a clamping channel for the leading and trailing printing form edges, the clamping channel being represented at an enlarged scale.

A flexible, plate-shaped printing form 10 is accommodated on a lateral surface 2 of printing form cylinder 1. A leading edge 12 and a trailing edge 13 of printing form 10 extend into a clamping channel 3 in printing form cylinder 1, the clamping channel being bounded by channel walls 4. Clamping channel 3 has a cross section having a more or less trapezoidal shaped profile, clamping channel 3 opening in a direction toward tensioning shaft 6. Clamping channel 3 is bounded at the bottom side by a tensioning shaft 6 in which a receiving slot 7 is formed. Receiving slot 7 is bounded by lateral contact surfaces 8 between which a continuous locating section of a one-piece spring element 27 or the locating sections of a plurality of spring elements 16 arranged side by side in clamping channel 3 are accommodated.

The direction of rotation of printing form cylinder 1, whose lateral surface 2 accommodates printing form 10, is denoted by the arrow provided with reference numeral 5. A radius 9 bounding the aperture of clamping channel 3 at lateral surface 2 of printing form cylinder 1 constitutes the location where leading edge 12 of printing form 10 is hung into place at a channel wall 4 of clamping channel 3. Printing form surface 11 of printing form 10 transfers the print image transferred thereto to the transfer cylinder which, in turn, transfers the print image to the stock, for instance, a continuous material web.

The representation according to FIG. 1 illustrates that a spring element 16 designed in Y-shape 21 is inserted in receiving slot 7 of tensioning shaft 6. This variant of an embodiment of the present invention includes spring element 16 having a first resilient section 17 and a second resilient section 19. First resilient section 17 and second resilient section 19 are each formed with different material thickness 20.1 and 20.2, respectively. First resilient section 17 and second resilient section 19 can be manufactured from different materials, respectively, which are joined via a joining operation to form a spring element 16. In the process, it is possible to provide both first resilient section 17 and second resilient section 19 with an individual flexural elasticity via the selection of material thickness 20.1 and 20.2. Y-shape 21 makes it easier for spring element 16 to be inserted into receiving slot 7 of tensioning shaft 6. Y-shape 21 is impressed on spring element 16 at a spreading location 26 at which second resilient section 19 branches off from first resilient section 17 at an angle of 10 to 30°. Depending on the selection of the angle of spread at spreading location 26, it is possible to predetermine the preloading of second resilient section 19 relative to first resilient section 17 of spring element 16. At its end gripping under a trailing edge angle 15 of trailing edge 13 of printing form 10, first resilient section 17 is angularly bent and provided with a hook-shaped curvature 18. Because of this, it is ensured that trailing printing form edge 13 is reliably grasped and tensioned in a circumferential direction on lateral surface 2 of printing form cylinder 1.

Second resilient section 19, which is formed with a smaller material thickness 20.2 compared to material thickness 20.1 of first resilient section 17, is configured to include a curved region 23. The side of curved region 23 facing leading edge 12 of printing form 10 constitutes a contact line 24 of second resilient section 19 with leading edge 12 at a contact region 22 through openings 25. Contact line 24 on second resilient section 19 can be provided with a coating which improves the coefficient of friction; besides, pin-shaped projections can be attached in the region of contact line 24 which are capable of extending through openings in leading printing form edge 12 which openings can optionally be formed therein for improving the fixing in place of leading printing form edge 12 on side wall 4 of clamping channel 3.

The narrower the aperture of clamping channel 3 between radii 9 at lateral surface 2 of clamping channel 3 is configured, the smaller is non-printing region 14 which forms between angularly bent leading printing form edge 12 and trailing printing form edge 13.

Figure 2:
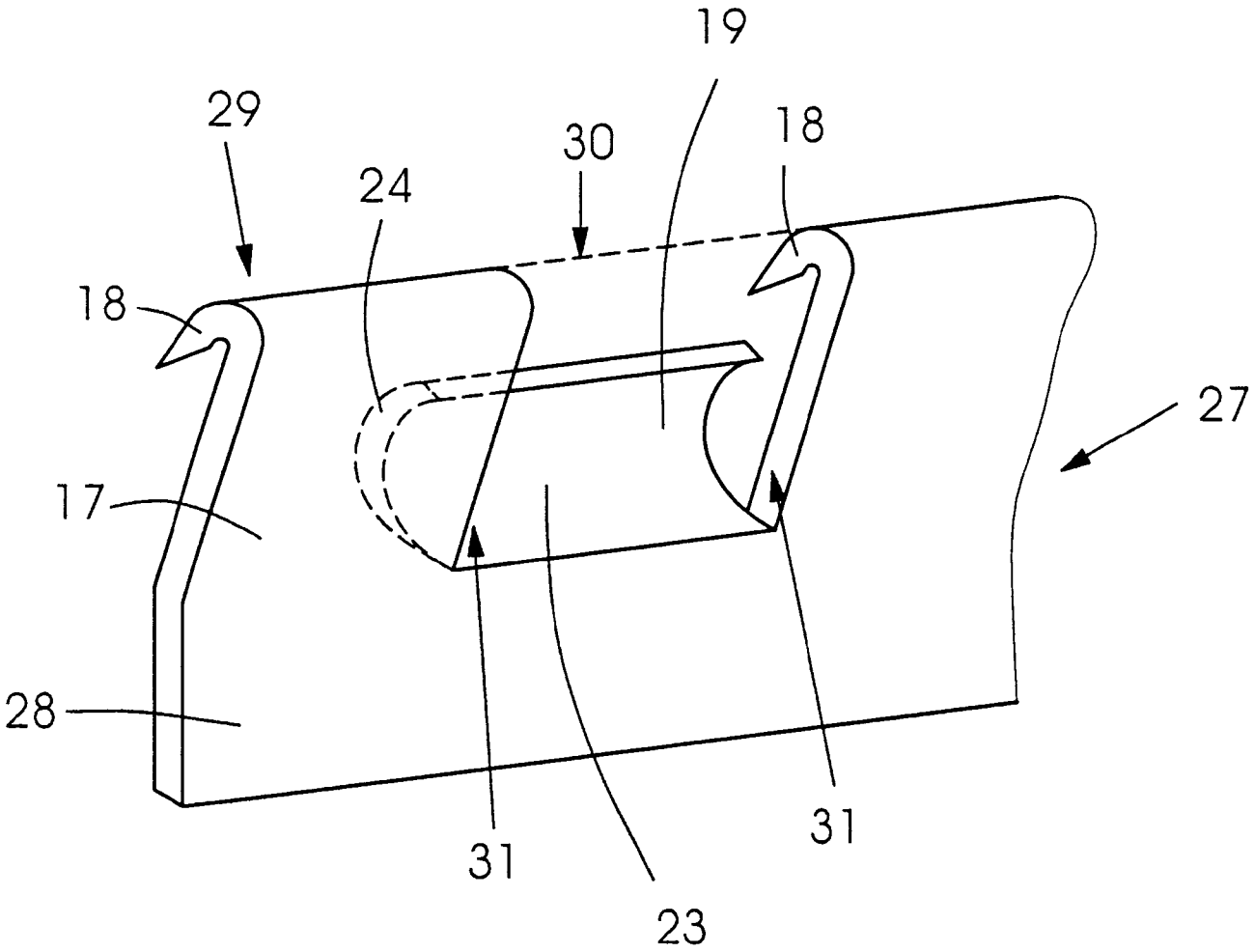
FIG. 2 shows a spring element formed in one piece, featuring a continuous locating section for the fastening on a tensioning shaft.

The representation according to FIG. 2 illustrates in greater detail a spring element formed in one piece, featuring a continuous locating section for the fastening on the tensioning shaft in the printing form cylinder.

In place of spring elements 16 depicted in FIG. 1 which are arranged side by side in a clamping channel 3, it is also possible to insert therein a one-piece spring element 27 which features a continuous locating section 28. This spring element 27 can have first resilient sections 17 and second resilient sections 19 alternately formed thereon in a segment-like manner. On spring element 27 designed in one piece, first and second sections 17 and 19 are separated from one another preferably by openings extending in a slot-shaped manner which are particularly easy to produce in terms of production engineering. Spring element 27 designed according to the variant of an embodiment in FIG. 2 is also substantially Y-shaped which is why it can be easily mounted in receiving slot 7 of a tensioning shaft 6 with smallest installation space requirements. Spring element 27 designed in one piece can likewise be inserted into a tensioning shaft 6 which is already accommodated in a bore of printing form cylinder 1. According to the variant of an embodiment of the spring element in FIG. 2, the ends of first resilient sections 17 are provided with rounded regions 29 so that during the handling of the spring element 27 configured in one piece with a continuous locating section, the risk of injury to the person handling it is markedly reduced. Subsequent to producing slot-shaped openings 31 through window or cut-out 30, spring element 27 configured in one piece can be manufactured by way of cold forming in a simple manner in terms of production engineering, the material thickness of first and second sections 17 and 19 being identical according to this variant of an embodiment of the spring element.

Figure 3:
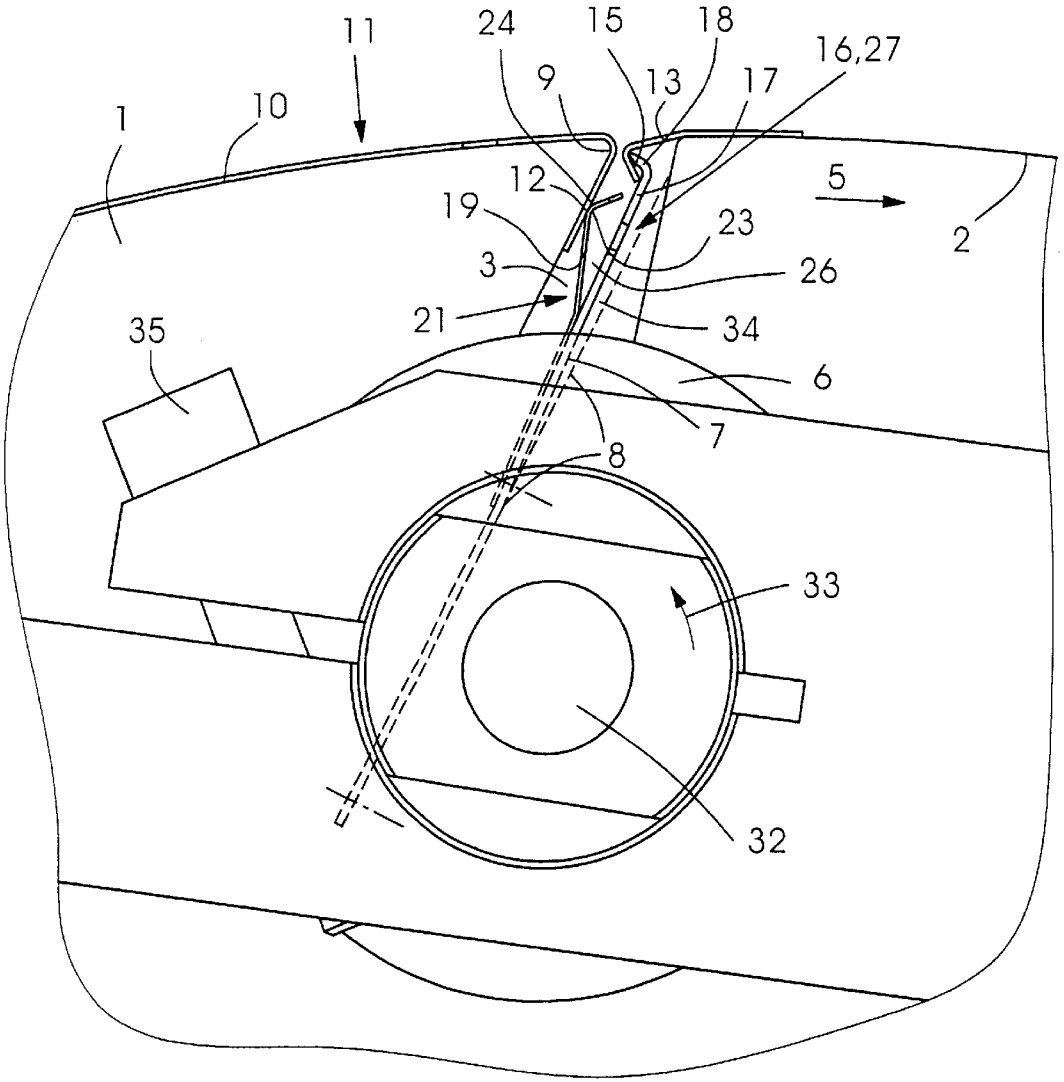
FIG. 3 depicts the spring element configured according to the present invention in an untensioned condition.

FIG. 3 illustrates in greater detail the spring element configured according to the present invention in an untensioned condition. Untensioned position 34 of spring element 16, 27 designed in Y-shape 21 is denoted by reference numeral 34. Spring element 16, 27 is inserted into receiving slot 7 of tensioning shaft 6 via its locating section. Trailing printing form edge 13 of printing form 10 to be tensioned in a circumferential direction on lateral surface 2 of printing form cylinder 1 is not yet grasped by curved, hook-shaped end 18 of first resilient section 17. Likewise, second resilient section 19 does not yet abut, via its linear contact region 24 opposite of curvature region 23, against leading edge 12 to be fixed in place of printing form 10 while spring element 16, 27 is in untensioned condition 34. In untensioned condition 34 of spring element 16 or 27, first resilient section 17 and second resilient section 19 are still undeformed relative to each other referred to spreading location 26, since no forces act upon first or second resilient section 17, 19 of spring element 16, 27 yet. Only when clamping shaft 3 is rotated counterclockwise in the direction of arrow 33, spring element 16, 27 designed in Y-shape 21 is converted from untensioned condition 34 into a first tensioning position 36 according to FIG. 4.

Figure 4:
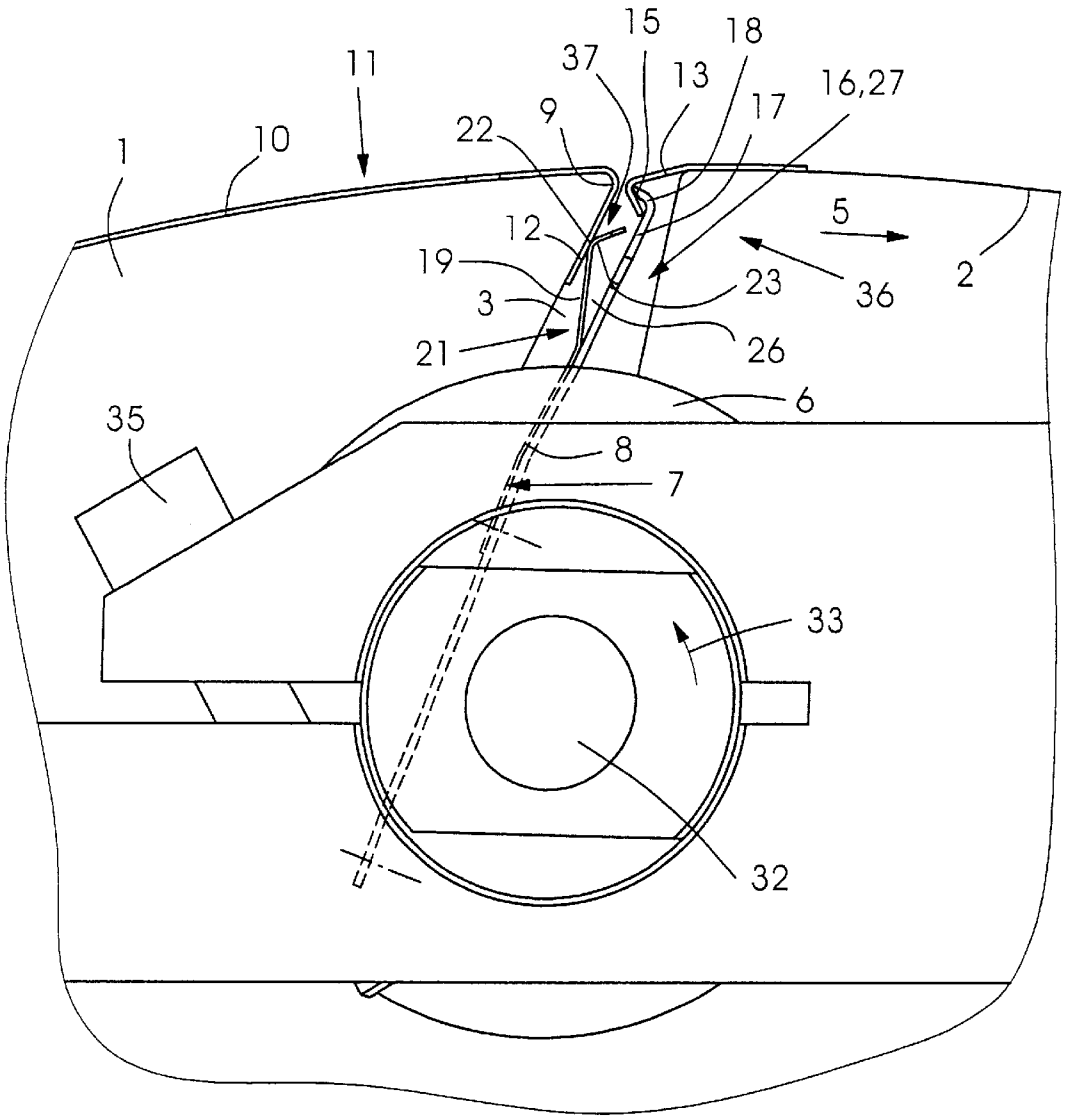
FIG. 4 is a view of the spring element designed according to the present invention in a first position tensioning the trailing printing form edge in a circumferential direction of the printing form cylinder.

The representation according to FIG. 4 illustrates in greater detail the spring element designed according to the present invention in a first position tensioning the trailing edge of the printing form in a circumferential direction on the printing form cylinder.

In comparison with FIG. 3, in the condition given in FIG. 4, a rotation of clamping shaft 6, with spring element 16, 27 configured according to the present invention being accommodated in receiving slot 7, has taken place in tensioning direction 33 of clamping shaft 6 so that the shaft is rotated counterclockwise about its axis 32. The then attained first tensioning position of spring element 16, 27 configured according to the present invention is denoted by position 36 and characterized in that hook-shaped end 18 of first resilient section 17 has grasped trailing edge angle 15 of printing form 10, tensioning it in a circumferential direction on lateral surface 2 of printing form cylinder 1. Accordingly, trailing edge 13 of printing form 10 is drawn onto clamping channel radius 9 in the direction of clamping channel radius 9 which is covered by leading edge 12 of printing form 10. In first tensioning position 36, the side of second resilient section 19 opposite of curved region 23 of this section just touches leading printing form edge 12 at contact region 22 which lies against a side of clamping channel 3. This contact position is denoted by reference numeral 37. When rotating clamping shaft 6 further in tensioning direction 33, second resilient section 19 moves toward first resilient section 17 of spring element 16, 27 which grasps the trailing edge with its hook-shaped end 17, referred to spreading location 26, compare FIG. 5.

For the sake of completeness, it should be mentioned that clamping shaft 6 is accommodated at its ends at the end face of a printing form cylinder 1 via a clamping 35, for example, in the form of a clamping screw.

Figure 5:
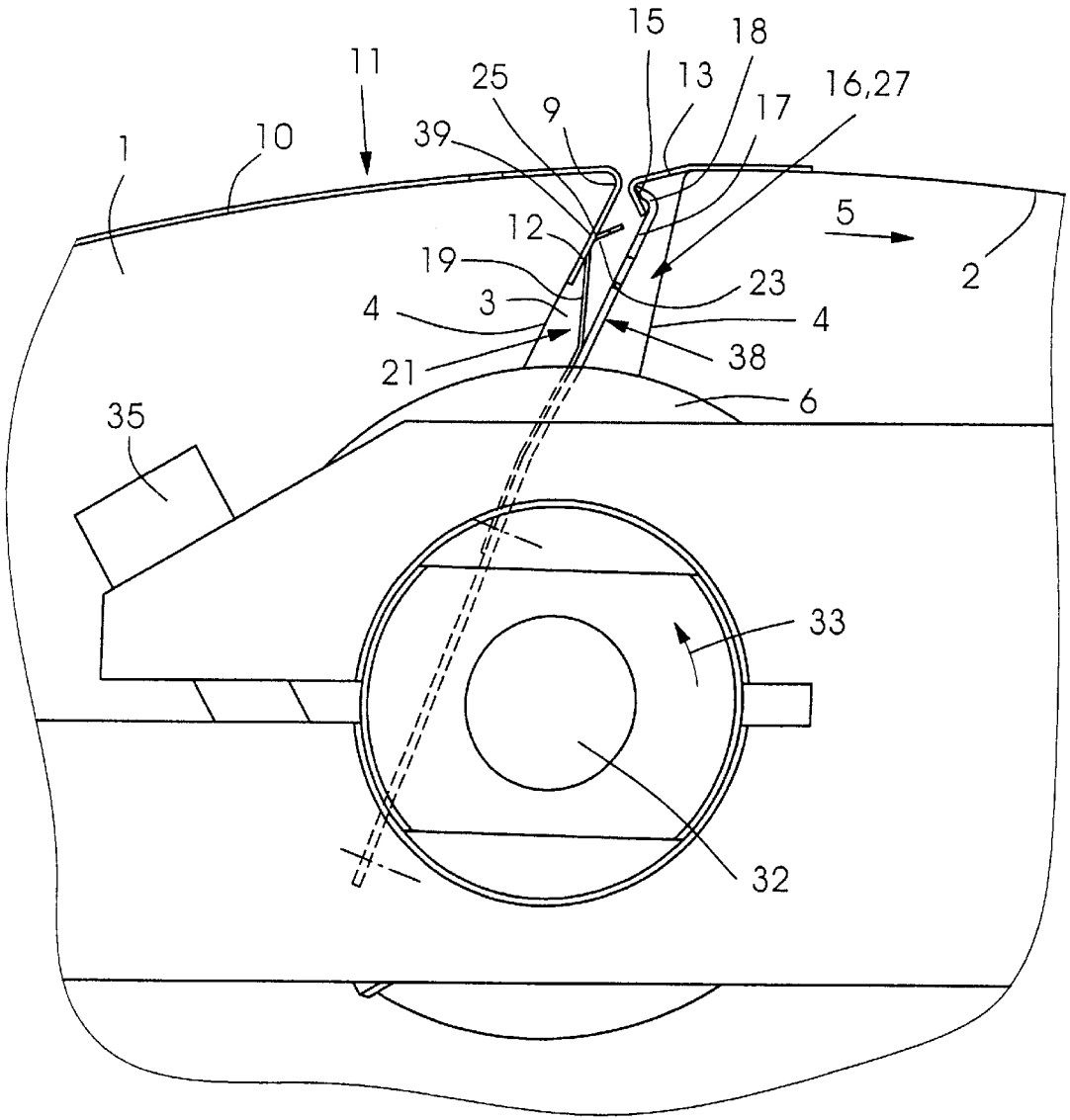
FIG. 5 shows the spring element made according to the present invention in a second tensioning position jointly fixing in place the leading printing form edge and the trailing printing form edge.

The representation according to FIG. 5 illustrates in greater detail the spring element configured according to the present invention in a second tensioning position which jointly fixes in place the leading edge and the trailing edge of the printing form.

Compared to first tensioning position 36, in the second tensioning position denoted by reference numeral 38, a further rotation of clamping shaft 6 has taken place in tensioning direction 33 about axis 32 of clamping shaft 6. Trailing edge 13 of printing form 10 is tensioned by hook-shaped end 18 in a circumferential direction relative to lateral surface 2 of printing form cylinder 1. In second tensioning position 38, second resilient section 19 makes contact with leading edge 12 of printing form 10 through openings 25 which leading edge lies against channel wall 4. Via second resilient section 19 of Y-shaped spring element 16, 27, a retention force is imposed on leading edge 12 of printing form 10, retaining leading edge 12 of printing form 10 on channel wall 4 of clamping channel 3. In second tensioning position 38, resilient section 19 has moved toward first resilient section 17 referred to spreading location 26 and, via its inherent flexural elasticity, retains leading edge 12 at tensioning position 39 in its position on channel wall 4 of clamping channel 3. In this second tensioning position 38, tensioning shaft 6 is locked so that, via the elasticity inherent in spring element 16, 27 configured in Y-shape 21, both trailing edge 13 of printing form 10 is permanently maintained tensioned in a circumferential direction on lateral surface 2 of printing form cylinder 1 and, at the same time, leading edge 12 of printing form 10 is maintained permanently fixed in place on channel wall 4 below clamping channel radius 9. During a rotation of printing form cylinder 1 with printing form 10 accommodated on lateral surface 2 being tensioned, ends 12 and 13 of printing form 10, whose surface 11 transfers the print image, are not able to move out of clamping channel 3 in a radial direction.

List of Reference Numerals

1 Printing form cylinder
2 Lateral surface
3 Clamping channel
4 Channel wall
5 Direction of rotation
6 Tensioning shaft
7 Receiving slot
8 Contact surface
9 Clamping channel radius
10 Printing form
11 Printing form surface
12 Leading edge
13 Trailing edge
14 Non-printing region
15 Trailing edge angle
16 Spring element
17 First resilient section
18 Hook-shaped end
19 Second resilient section
20.1 Material thickness of first resilient section
20.2 Material thickness of second resilient section
21 Y-shape
22 Contact region of leading edge
23 Curvature region
24 Contact line
25 Openings of leading printing form edge
26 Spreading location
27 Segmented spring element
28 Locating section
29 Rounded end
30 Window or cut-out
31 Slot-shaped openings
32 Axis of tensioning shaft
33 Tension direction of tensioning shaft
34 Untensioned position
35 Clamping
36 First tensioning position
37 Contact position
38 Second tensioning position
39 Tensioning position

What is claimed is:

1. A device for fastening a printing form having a leading edge and a trailing edge onto a printing form cylinder of a rotary printing press, the leading edge and the trailing edge being tensioned and retained in a clamping channel of the printing form cylinder, the device comprising:

a tensioning shaft; and at least one clamping element accommodated on the tensioning shaft;

the at least one clamping element being a Y-shaped spring element including a first and a second resilient section, wherein the first and second resilient sections are made of flexurally elastic material of different material thickness, and wherein the first resilient section has an angularly bent, hook-shaped end for grasping the trailing edge of the printing form.

2. The device as recited in claim 1, wherein the second resilient section branches off from the first resilient section at a forking location.

3. The device as recited in claim 1, wherein the second resilient section is formed with a smaller material thickness than the first resilient section.

4. The device as recited in claim 1, wherein the second resilient section features a curved region, the curved region having a side facing the leading edge of the printing form so as to form a linear contact region.

5. The device as recited in claim 1, wherein the spring element is formed in one piece with a continuous locating section, the first and second resilient sections projecting from the locating section so as to define a Y-shape.

6. The device as recited in claim 5, wherein the first and second resilient sections are separated from each other by slot-shaped openings.

7. The device as recited in claim 5, wherein the hook-shaped end of the first resilient section is curved.

8. A printing for cylinder in a printing unit of a rotary printing press comprising:

an outer surface having an axially-extending clamping channel; and a device for fastening a printing for having a leading edge and trailing edge, the leading edge and trailing edge being tensioned and retained in the clamping channel, the device including:

a tensioning shaft; and at least one clamping element accommodated on the tensioning shaft;

the at least one clamping element being a Y-shaped spring element including a first and a second resilient section, wherein the first and second resilient sections are made of flexurally elastic material of different material thickness, and wherein the first resilient section has an angularly bent, hook-shaped end for grasping the trailing edge of the printing form.

9. The device as recited in claim 8, wherein the at least one clamping element includes a plurality of spring elements accommodated side by side axially in the clamping channel.

* * * * *